United States Patent [19]

Talley

[11] 4,249,833

[45] Feb. 10, 1981

[54] METHOD OF DEPRESSURIZING A LEACHED SALT CAVERN

[76] Inventor: Billy D. Talley, 6110 Shadycliff, Dallas, Tex. 75240

[21] Appl. No.: 60,403

[22] Filed: Jul. 24, 1979

[51] Int. Cl.[3] ..... E21F 17/16; E21B 43/28

[52] U.S. Cl. ..... 405/58; 299/5

[58] Field of Search ..... 405/53–58; 299/4, 5

[56] References Cited

U.S. PATENT DOCUMENTS

| | | | |
|---|---|---|---|
| 2,994,200 | 8/1961 | Carpenter | 405/58 |
| 3,066,732 | 12/1962 | McEver | 405/58 |
| 3,083,770 | 2/1963 | Villalon et al. | 166/124 |
| 3,088,717 | 5/1963 | Myers | 405/58 X |
| 3,632,171 | 1/1972 | French | 299/5 |

*Primary Examiner*—Dennis L. Taylor

*Attorney, Agent, or Firm*—Young & Thompson

[57] ABSTRACT

A salt cavern is leached with fresh water by cementing its surface casing in a hole to the depth of the roof of the cavern to be leached, and inserting coaxial short and long leach strings into the hole, with a petroleum liquid between the surface casing and the outer leach string to protect the roof salt from dissolution when fresh water is run down one of the leach strings and the produced brine out the other. To check the progress of cavern formation, the leach strings are removed to permit unimpeded sonar survey; but before this can be done, the pressures within the surface casing and the short and long leach strings must be neutralized, because the petroleum liquid and fresh water and brine all have different specific gravities and so exert different hydrostatic heads. Moreover, as salt dissolution continues during pressure equalization, the specific gravity of the brine changes, so that pressure equalization can take several days. The present invention shortens the pressure equalization time, by pumping petroleum liquid into the annulus between the leach strings, to the same level as the existing petroleum liquid in the annulus between the surface casing and the outer leach string, then inserting a plug in the central leach string at that same level and replacing the aqueous liquid above this plug with petroleum liquid. Finally, the pressure beneath the plug is released, whereupon the cavern has been depressurized and the leach strings can be raised.

1 Claim, 1 Drawing Figure

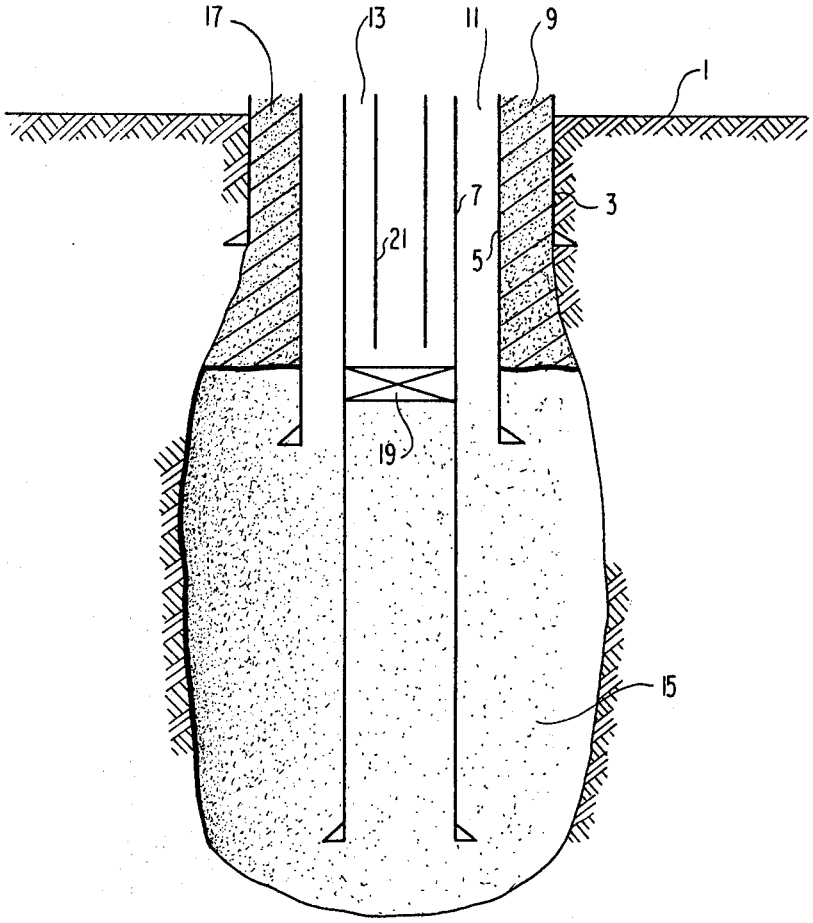
17
13
11
9
1
7
3
21
5
19
15

METHOD OF DEPRESSURIZING A LEACHED SALT CAVERN

The present invention relates to depressurizing salt caverns during the course of their construction by aqueous leaching, so that the leach strings can be removed and a survey instrument such as sonar can be introduced to monitor the progress of leaching.

It is of course known to leach salt domes with aqueous liquids, to provide storage caverns for hydrocarbons. In this conventional process, a hole is drilled and surface casing inserted and cemeneted to a depth in the salt to provide a desired roof thickness of salt.

Two or more strings of casing are then run inside the surface casing, to serve as leaching strings. These strings are of unequal length, the longer being the inner and the shorter the outer. Fresh water is pumped through one string into the cavern to be leached, where it dissolves a portion of the salt so as progressively to enlarge the cavern, the brine thus produced passing out through the other of the strings, the difference in length of the strings ensuring that the water will move through a substantial portion of the height of the cavern thereby to augment leaching.

To prevent salt from being washed from the top of the cavern, which would reduce the roof thickness, an inert liquid such as oil or diesel fuel is pumped into the annulus between the surface casing and the outer or shorter leach string. Eventually, this hydrocarbon liquid will be extended below the surface casing but of course not below the short leach string. The hydrocarbon liquid is not a solvent for the salt, and has a specific gravity less than that of water, and is immiscible with water, so that it serves as a protective blanket that is neither displaced nor consumed during leaching.

These methods are well known, as disclosed for example in U.S. Pat. Nos. 2,787,455, 3,632,171 and 3,716,272, the disclosure of which are incorporated herein by reference.

At various stages it is necessary to stop the leaching process and to insert a survey tool such as sonar into the cavern to determine its size, shape and volume, all of which are important to the stability of the cavern. But in order to get an accurate survey, it is necessary to remove the leach strings. Before the leach strings can be removed, however, the cavern must be depressurized, which means that there must not be any difference in hydrostatic pressure across the entire width of any imaginary horizontal plane passing through the cavern, so that there will be no flow of one liquid relative to another. A pressure differential exists, because the hydrocarbon liquid and the fresh water and the brine all have different specific gravities and so, at the same height, exert different hydrostatic heads.

In the past, depressurization has been effected simply by opening the valves that hold the pressure on the outer annulus between the surface casing and short leach string, and between the short and long leach strings. The brine, which is the densest, falls in level while the fresh water and petroleum liquid rise and flow out, until all three columns of liquid have the same hydrostatic head.

But it is not that simple: in fact, salt from the cavern walls keeping dissolving in the water until the water becomes saturated, that is, the brine keeps increasing in density. Thus, the density and hence the hydrostatic heads of the liquids relative to each other do not remain constant but change until saturation of the brine is achieved. This takes several days; and so it is obvious that each depressurization adds greatly to the cost of producing the cavern.

Accordingly, it is an object of the present invention greatly to shorten the time for depressurization.

It is also an object of the invention to provide such a shortened process for depressurizing a salt cavern, which is useful not only when a single well penetrates the salt cavern but also when plural wells penetrate the same cavern.

Briefly, these objects are achieved by a process comprising in combination the following steps:

1. Petroleum liquid is injected into the annulus between the leach strings, to the same depth as the petroleum liquid in the outer annulus. The long leach string, which is the central leach string, is open; and the displaced aqueous liquid moves up and out the central string.

2. A packer plug is then inserted in the central string to about this same level; and the aqueous liquid above the packer is replaced with petroleum liquid.

3. The replacement of the aqueous liquid above the packer plug with petroleum liquid of lower density means that there is now a higher pressure on the underside of the plug than on the upper side; and this pressure is relieved through the plug through tubing to the surface, whereupon the packer plug is retrieved, leaving the well equalized.

4. The leach strings can then be lifted and a sonar or other survey tool inserted for an unimpeded survey of the cavern wall.

These steps can be repeated for other wells of the same cavern, whose leach strings can also be removed.

Other objects, features and advantages of the present invention will become apparent from a consideration of the following description, taken in connection with the accompanying drawing, which is a schematic cross-sectional view of a salt cavern in the course of leaching, showing the position of the packer at a time just prior to the release of pressure beneath the packer.

In the drawing, the structure above ground, comprising valves and conduits by which liquids are introduced into and removed from the various passages and by which pressure is held selectively on any of these passages, are all quite conventional and so need not be illustrated.

Referring now to the drawing in greater detail, it is of course well known that a salt cavern is formed by first forming a hole in ground 1 above the cavern to be leached out. A relatively short length of surface casing 3 is then cemented into this hole, whereupon outer and inner leach strings 5 and 7, respectively, are inserted, the casing 3 and leach strings 5 and 7 being concentric thereby to define an annulus 9 between 3 and 5 and an annulus 11 between 5 and 7, the interior of string 7 being shown at 13.

Fresh water is inserted in one or the other of 11 or 13 and flows downward into contact with the subterranean salt, leaching the same to form brine, which then passes back up through the other of 11 and 13 to form a progressively expanding cavern 15.

To ensure that the water does not leach out the roof of cavern 15, an inert liquid 17 is injected into 9, to a depth equal to the desired thickness of the cavern roof, that is, to the lower end of surface casing 3. More inert liquid will subsequently be injected, to lower the inert liquid-water interface to a level below the lower end of surface casing 3, so that inert liquid provides a protective blanket against the underside of the cavern roof; although of course the inert liquid will never be injected to a depth below the lower end of the short leach string 5.

Of course, as cavern 15 deepens, long leach string 7 will be progressively lowered, thereby to lengthen the vertical extent of the path followed by the aqueous leaching liquid.

As used in the specification, when speaking of the protective liquid 17, the term "inert" means a liquid which is not a solvent for salt and which is immiscible with water and which has a specific gravity less than that of water, so that it always floats on the water in the position shown in the drawing and does not permit water to leach the cavern walls with which the inert liquid is in contact. Ordinarily, the inert liquid will be a petroleum liquid, such as oil or diesel fuel.

Thus far, the process is entirely conventional, as described in the patents listed above.

What is novel and patentable is as follows:

To depressurize the cavern, 9 and 11 are shut-in with pressure. Then inert liquid is injected in 11 until the level of the inert liquid in 9 and 11 is about equal, whereupon 11 is again shut-in.

Next, a packing plug 19 is inserted in 13 to about that same level, by means of tubing 21 which is detachable therefrom and which, when attached thereto, can selectively communicate with space 13 below plug 19, thereby, at a later stage, to permit release of pressure from beneath 19 through 21 to the surface.

With plug 19 closed, tube 21 is detached therefrom by rotation and is raised to the position shown in the drawing, that is, to a position in which the lower end of tube 21 is spaced a short distance above plug 19. Then, inert liquid is injected into 21 and displaces aqueous liquid from 13. As a result, the interface between inert liquid and aqueous liquid is about the same in 9, 11 and 13.

Then tubing 21 is re-attached to plug 19. At this point, there is a pressure differential across plug 19, because the aqueous liquid above plug 19 was replaced by a lighter inert liquid. Therefore, this pressure differential is relieved through plug 19 and tubing 21 to the surface, whereupon tubing 21 can be used to retrieve plug 19.

The plug 19 and tubing 21 constitute a conventional packer plug with expanding anchor, which may be any of a number of well-known types as those skilled in the art will appreciate. They can of course be of the known type in which tube 21 is detached from and raised above plug 19, or of the known type in which tubing 21 and plug 19 remain attached and a valve opens through tubing 21 upon the imposition of torque or by setting down tubing weight. A particular example is Halliburton Company's Retrievable Test-Treat-Squeeze packer Type H. Other well-known types are disclosed in U.S. Pat. Nos. 3,042,116, 3,083,770, 3,584,684, 3,847,223 or 3,856,085, the disclosure of which is incorporated herein by reference. The particular structure of plug 19 and tubing 21 is entirely conventional and forms no part of this invention.

The leach strings 5 and 7 can then be removed and a sonar or other survey instrument inserted in the cavern 15, after which survey the leach strings can be reinserted and leaching can resume.

It is also known in the art to use plural wells for forming a single cavern, in which case the wells are horizontally spaced apart so as to extend down into various portions of the cavern. In this event, it is necessary to release pressure through plug 19 and up through tubing 21 to the surface only in connection with one of the plural wells, provided that the process has been carried to this point in all of the wells.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A method of depressurizing a salt cavern in which surface casing has been inserted to about a depth corresponding to the height of the roof of the cavern to be formed and inner and outer leach strings have been inserted in the surface casing and cavern to define between the surface casing and the outer leach string a first annulus and between the two leach strings a second annulus and in which an inert liquid has been injected in said first annulus to protect the cavern roof against leaching and to form an interface with aqueous leaching liquid in the cavern, which method comprises shutting in said first and second annuli with pressure, inserting inert liquid into said second annulus to displace said aqueous liquid down to about the level of said interface, inserting a packing plug in said inner string at about said level, replacing aqueous liquid above said plug with inert liquid, releasing pressure from beneath said packing plug through tubing to above the surface, and retrieving said packing plug from said inner string.

* * * * *